United States Patent [19]

Albee, Jr.

[11] 4,017,049

[45] Apr. 12, 1977

[54] EASEL

[75] Inventor: Percy Frederick Albee, Jr., Barrington, R.I.

[73] Assignee: Q-Panel Company, Providence, R.I.

[22] Filed: May 22, 1972

[21] Appl. No.: 255,561

[52] U.S. Cl. ..... 248/464; 248/465

[51] Int. Cl.[2] ..... A47B 97/04

[58] Field of Search ..... 248/169, 171, 188.5, 248/463, 464, 465, 460, 246

[56] References Cited

UNITED STATES PATENTS

| | | | |
|---|---|---|---|
| 1,239,136 | 9/1917 | Stone | 248/169 X |
| 2,473,351 | 6/1949 | Thompson et al. | 248/188.5 |
| 2,550,550 | 4/1951 | Goodstein | 248/465 |
| 2,638,300 | 5/1953 | De Jen | 248/464 |
| 2,746,822 | 5/1956 | Copenhaver | 248/188.5 |

*Primary Examiner*—William H. Schultz
*Attorney, Agent, or Firm*—Barlow & Barlow

[57] ABSTRACT

An easel having a tripod stand each of whose legs are telescopically mounted in tubular sleeves. A traveller unit is mounted on one of the sleeves and it has attached thereto cross brace members whose opposite ends are connected to the other respective sleeves. The traveller unit has a pair of legs extending angularly downwardly from the sides of a platform to form a channel between the legs. A cross member connects the tips of the legs and forms an opening into which a middle sleeve is received and which acts as a guide for the traveller unit as it slides upwardly and downwardly when setting up or collapsing the easel. A pair of pad holder units are attached to the other sleeves and are positionable on the sleeves at an infinite number of heights due to the frictional clamping nature of their structure when a load is supported thereon. Cooperating structure is formed on the sleeves and leg members which allow the length of the legs to be varied by utilizing resiliently biased leaf springs.

5 Claims, 10 Drawing Figures

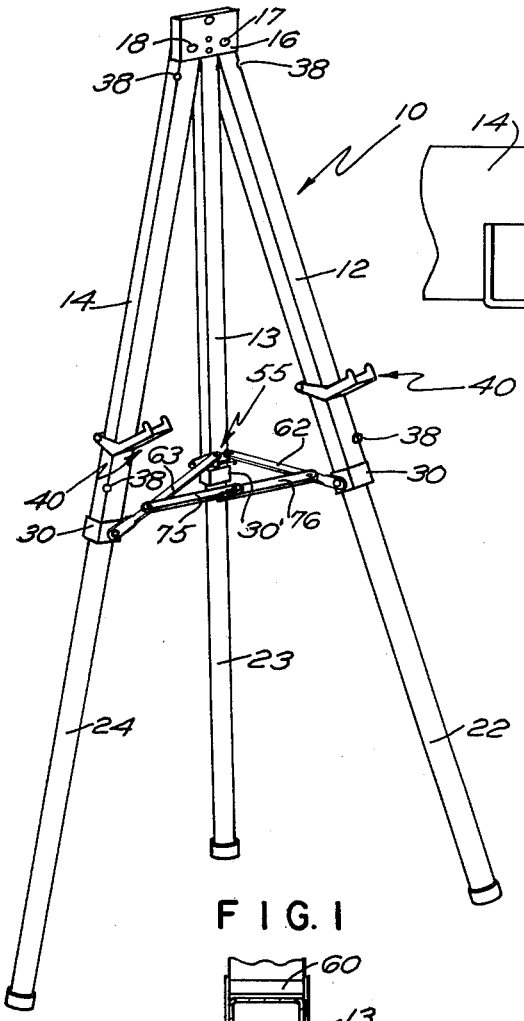
F I G. 1
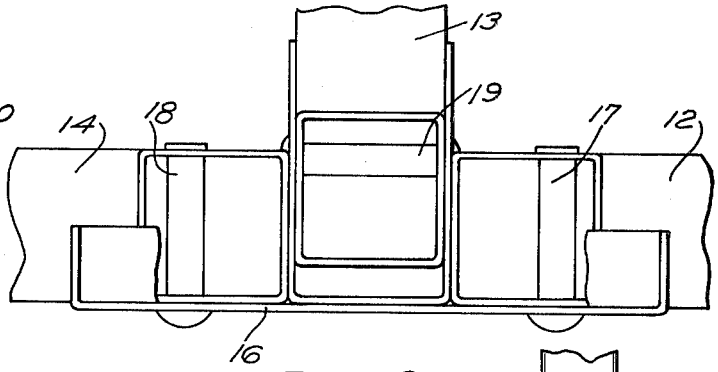
F I G. 2
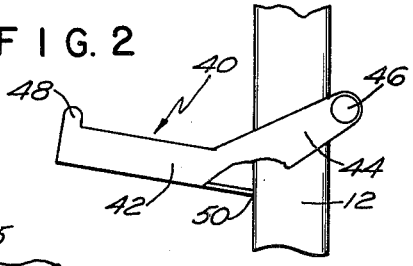
F I G. 5A
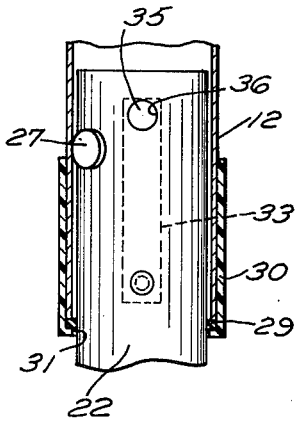
F I G. 3
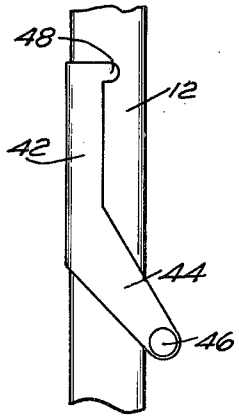
F I G. 5B
F I G. 4
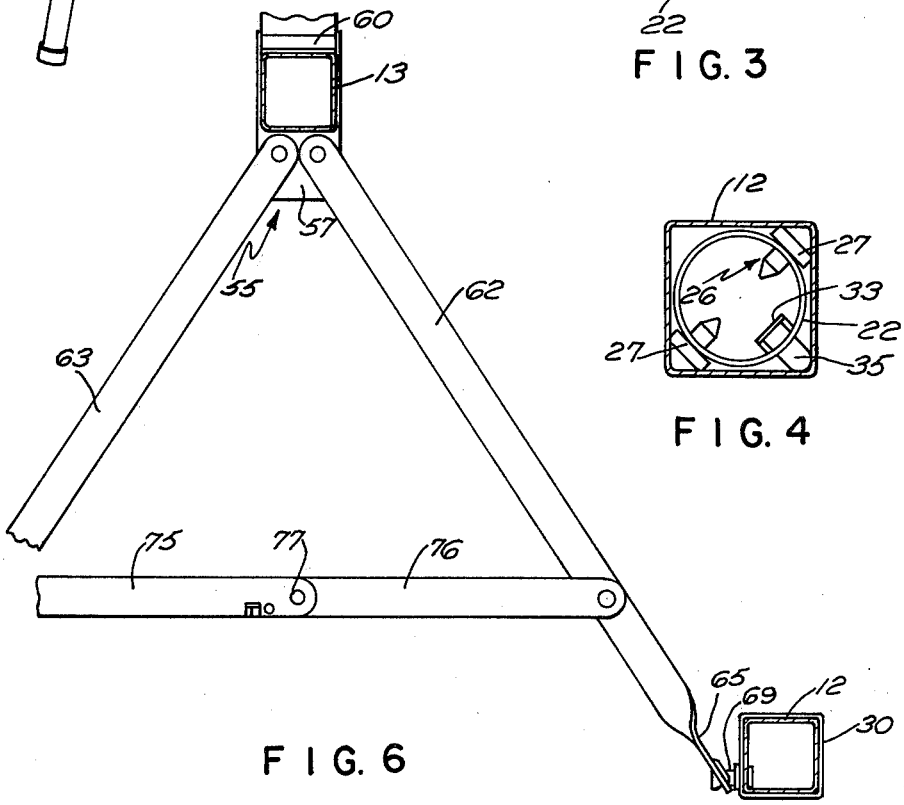
F I G. 6

EASEL

BACKGROUND OF THE INVENTION

This invention relates primarily to easels such as adapted for use by artists, students and others for painting, sketching and other purposes. In the past easels have been designed in many configurations and with many different types of structure which allow them to be folded or collapsed into a compact unit. Most of these units are complicated to manufacture and assemble due to the nature of the folding structure utilized. Also complicated structures have been used in order to give the pad holder units vertical adjustability. Another problem has resulted from the difficulty in folding the cross brace members into an adjacent position with the sleeves of the easel. Binding of the legs within the sleeve as they are telescoped together has also produced great dissatisfaction in the past. Additionally the structure for locking the legs to the sleeve members has been limited by the number of stop positions available for varying the height of the easel as set up.

SUMMARY OF THE INVENTION

The present novel easel structure solves many of the problems of the past. This easel may be set up in its expanded condition quite quickly and just as quickly may be collapsed to a compact carrying state. The novel structure of the traveller unit eliminates the possibility of the unit binding on its sleeve as it travels back and forth thereon. Also this structure allows the traveller unit to fold compactly against that sleeve when the easel is in its compact state. The novel manner of tieing or attaching the cross brace members to the other sleeves likewise allows the cross brace members to lie compactly adjacent their respective sleeves when the easel is in its collapsed state. The unique pad holder units are the most easily slidable ones ever designed and allow for an infinite number of locking positions to be obtained on the sleeve members. The telescoping legs may be positively locked in various positions by utilizing leaf spring members each having one of their ends attached to the leg members. Pins protruding outwardly from the free ends of the spring members are engageable in any of the apertures spaced longitudinally along the sleeve members and these provide positive locking positions.

It is an object of this invention to provide a compact collapsible easel.

It is an object of this invention to provide an easel with novel pad holder units capable of being locked in an infinite number of heights on the easel sleeves and ones which fold compactly into adjacent alignment with the sleeves.

It is also an object of the invention to provide a novel traveller unit that will not bind on its sleeve member as it travels upwardly and downwardly and which also folds completely into adjacent alignment with its sleeves.

An additional object of the invention is to provide a novel hinge or pivoting structure for attaching the cross brace members to the sleeves that will allow the cross brace members to fold compactly into adjacent alignment with the sleeves to which they are attached.

A further object of the invention is to provide an easel with telescoping legs that won't bind when telescoped into their sleeves and which may be locked in an infinite number of positions within the length of the sleeves.

DESCRIPTION OF THE DRAWINGS

FIG. 1 is a perspective view of the easel;

FIG. 2 is a partial top plan view of the easel;

FIG. 3 is a partial cross section view illustrating the positive clamping means attached to the leg member;

FIG. 4 is a cross section view illustrating a leg member telescoped into one of the sleeves;

FIG. 5A is a partial side elevation view of the pad holder unit in its operational position;

FIG. 5B is a side elevational view of the pad holder unit in its collapsed position;

FIG. 6 is a partial cross section view of the easel taken at a height just above the traveller unit;

DESCRIPTION OF THE PREFERRED EMBODIMENT

Figure 5C:
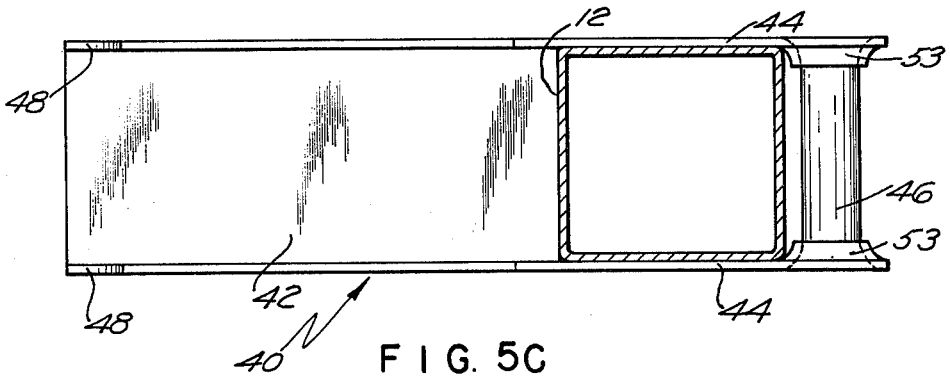
FIG. 5C is a top plan view of the pad holder unit illustrated in FIG. 5A.

Referring first to FIG. 1, the easel is illustrated in a perspective view and is generally designated numeral 10. The easel has three sleeves 12, 13 and 14, which are pivotally secured to plate 16 at their top (See FIG. 2). Sleeves 12 and 14 pivot about pins 17 and 18 respectively which are parallel to each other. Sleeve 13 pivots about pin 19 whose axis is perpendicular to that of the other two pins.

Telescopically connected within said sleeves are legs 22, 23 and 24. The manner in which they are locked in position with respect to each other is best illustrated by locking at FIGS. 3 and 4. It is there seen that leg 22 which is representative of all the legs has nylon bearing guides 26 inserted through apertures in the wall of the leg with the shoe portion 27 of the guides riding along the inner surface wall of sleeve 12. By the use of these nylon bearing guides any sticking between the sleeve and leg member while they are being telescoped together is eliminated. Nylon bearing 29 which is inserted in cap 30 which as shown in FIG. 3 surrounds the end of each sleeve and prevents any binding of the leg as it passes through aperture 31 of the cap since its bore diameter is less than the diameter of aperture 31 of the cap. The manner of locking the leg with respect to the sleeve is accomplished by leaf spring member 33 which is rivetally secured to the inner surface of the leg member. Pin 35 are attached to the free end of the leaf spring and is directed radially outwardly through aperture 36 in the leg members. When the pin member is aligned with any of the apertures 38 formed in the sleeve, it will spring into place thus locking the relationship between the two members. In order to move the leg to another position within the sleeve member, it is only necessary to depress the pin through aperture 38 until its top is cleared and then slide the leg along until a desired aperture 38 is located and into which the pin is desired to be inserted. By looking at FIG. 4 it can be seen how leaf spring 33 is biased inwardly during its travel between the locking positions provided by apertures 38.

The pad holder units 40 are illustrated in their different positions in FIGS. 5A, 5B and 5C. These novel members have a channel-shaped arm 42 with a pair of spaced legs 44 extending angularly upwardly from the sides of the arm member to form a channel between the legs. Rivet pin 46 is attached between the end of said legs thereby forming an opening which receives one of the sleeve members and upon which the pad holder units may travel when their height is adjusted upwardly or downwardly. In FIG. 5A the pad holder unit is illustrated in its supporting position with fingers 48 preventing material from sliding forward off the channel arm. The manner of the pad holders engagement on the sleeve is such that when a weight or mass is placed on arm 42 point 50 becomes a fulcrum around which the weight on the pad holder unit attempts to pivot and this brings the inwardly recessed bossed surfaces 53 (see FIG. 5C) into frictional engagement with the opposite side of the sleeve member. Upon removal of any weight or mass from the pad holder arm 42 the unit may be folded upwardly and easily moved to any desired height along the sleeve member where it may be reset to its outwardly extending position. Alternately when it comes time to collapse and fold the easel away, the pad holder unit may be folded compactly against the sleeve member as illustrated in FIG. 5B.

Figure 7:
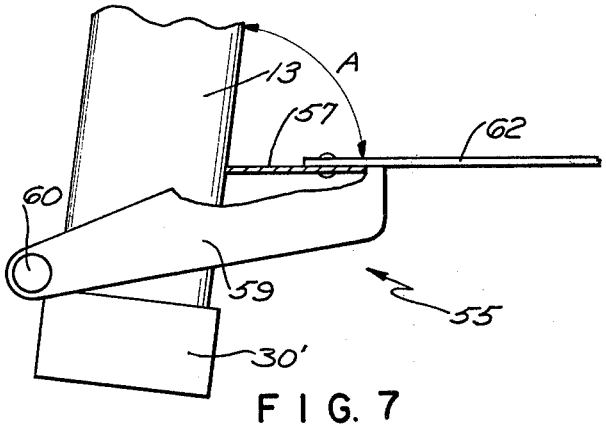
FIG. 7 is a partial side elevation view of the traveller unit.
Figure 8:
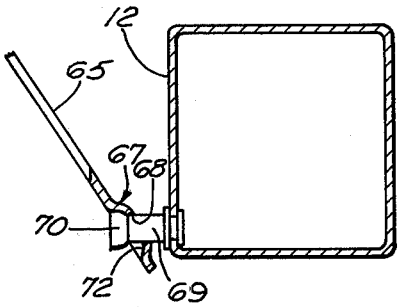
FIG. 8 is a partial cross section view illustrating how the brace member is connected to the sleeve member.

The traveller unit 55 which is instrumental in bracing the easel in its set up position is best illustrated in FIGS. 6 and 7. Its structure is quite similar to that of the padholder unit in that it has a channel-shaped platform 57 which has a pair of legs 59 extending angularly downwardly therefrom to form a channel between the legs. A rivet pin 60 closes the open end of the channel thus forming an opening which receives sleeve 13 along which the traveller unit slides downwardly during setting up said easel until the traveler 55 engages the cap 30 which acts as a stop. In this stopped position the platform 57 will make an angle A (FIG. 7) with the sleeve 13 less than 90° tending to lock the traveler in position by downward pressure on the platform. Any force exerted in the plane of the platform will tend to move it downwardly, in this case, until it abuts the cap 30 which acts as a stop member to provide the plane of the platform substantially horizontal. In this position the cross brace members 62, 63 hold the sleeves 12, 13, 14 in their spread position (see FIG. 6). Due to the similarity in structure of the pad holder unit and the traveller unit, it is easily seen how it would compactly fold up adjacent to sleeve 13 much in the same manner as illustrated in FIG. 5B. To the top of channel-shaped platform 57 are attached cross brace members 62 and 63. At their opposite ends they have a 90° twisted tip member 65 which is secured to the sleeve members. Referring to FIG. 8 tip 65 has a depressed dimple 67 having an aperture 68 therein. Passing through said aperture is a pin 69 whose one end is permanently secured to said sleeve member. The opposite end of said pin has a head 70 thereon whose undersurface is convex. This convex surface seats in concave surface 72 of the depressed dimple to form a type of universal joint between the pin and the dimple. This maneuverability is enhanced by the fact that the aperture 68 is oversized with respect to the diameter of pin 69. It is thus seen that as traveller unit 55 is drawn upwardly along sleeve 13 brace sectors 75 and 76 will pivot about pin 77 to allow the three sleeve members to collapse inwardly toward each other. Due to the aforedescribed structure of said brace tip 65 and pin 69 the sleeves may be collapsed into a compact unit.

What is claimed is:

1. An easel comprising a. at least three sleeves, b. means pivotally securing said sleeves together at one of their ends to form the top of the easel, c. a leg telescopically mounted in each of said sleeves, d. brace means connecting said sleeves at a position spaced downwardly from the top of said easel, said brace means comprising a traveller unit mounted on one of said sleeves, said one of said sleeves having a cap member at the end remote from the top pivotal means, cross brace members connecting said other sleeves to said traveller unit, said traveller unit comprising a platform, a pair of legs extending angularly downward from the sides of the platform to form a channel between the legs and receiving said one of said sleeves therein and means extending between said traveller legs closing the open end of the channel whereby an opening is formed which receives the sleeve as the traveller moves downwardly within said opening during setting up, said cap member limiting the downward movement of the traveller, the traveller unit platform extending toward the said one of said sleeves at the cap member at an angle whereby a force tending to collapse the opened legs will engage the platform with the sleeve and tend to move the traveller unit downwardly.

2. An easel as recited in claim 1 further comprising pad holder means having at least two units, each unit being formed with an outwardly extending arm member, a pair of legs extending angularly upwardly from the sides of the arm member to form a channel between the legs and means closing the open end of the channel whereby an opening is formed which receives the sleeve upon which the pad holder units travel when their height is adjusted upwardly or downwardly.

3. An easel as recited in claim 1 wherein said sleeves are square and said legs are tubular and further comprising nylon bearing shoe means attached to the outer surface of said legs across one diameter thereof to reduce friction when the legs are telescopically moved within said sleeves and to provide a bearing for a tubular leg in a square sleeve.

4. An easel comprising a. at least three sleeves, b. means pivotally securing said sleeves together at one of their ends to form the top of the easel, c. a leg telescopically mounted in each of said sleeves, d. pad holder means having at least two units, each unit being formed with an outwardly extending arm member, a pair of legs extending angularly upwardly from the sides of the arm member beyond said sleeve to form a channel between the legs in which said sleeve is located and means beyond said sleeve closing the open end of the channel whereby an opening is formed which slidably receives the sleeve upon which the pad holder units travel when their height is adjusted upwardly or downwardly.

5. An easel comprising a. at least three tubular sleeves, b. means pivotally securing said tubular sleeves together at one of their ends to form the top of the easel, c. a leg telescopically mounted in each of said tubular sleeves, d. brace means connecting said tubular sleeves at a position spaced downwardly from the top of said easel, said brace means comprising a traveller unit mounted on one of said sleeves, and cross brace members connecting said other sleeves to said traveller unit, said traveller unit comprising a platform, a pair of legs extending angularly downward from the sides of the platform to form a channel between the legs and means closing the open end of the channel whereby an opening is formed which receives the sleeve that travels upwardly and downwardly within said opening during setting up and collapsibly folding said easel, e. each of the ends of said cross brace members spaced from the traveller unit being pivotally connected to pins mounted on the said sleeves, the ends of said brace members having a oversized aperture as compared to the diameter of said pins, the area around said apertures being curved upwardly to provide a concave bearing surface for a mating convex surface on said pins thereby producing a form of a universal joint.

* * * * *